US005652949A

United States Patent [19]

Ogawa et al.

[11] Patent Number: 5,652,949

[45] Date of Patent: Jul. 29, 1997

[54] PREHEATING CONTROLLER FOR A TWO-STAGE ELECTROPHOTOGRAPHIC PRINTING SYSTEM

[75] Inventors: Hiroyuki Ogawa, Hitachinaka; Shuho Yokokawa, Mito; Hiroshi Hakuta, Hitachinaka; Takao Chikuzenya, Hitachinaka; Isao Nakajima, Hitachinaka; Hiroshi Ueno, Hitachinaka, all of Japan

[73] Assignee: Hitachi Koki Co., Ltd., Tokyo, Japan

[21] Appl. No.: 668,322

[22] Filed: Jun. 26, 1996

Related U.S. Application Data

[63] Continuation of Ser. No. 418,433, Apr. 7, 1995, abandoned.

[30] Foreign Application Priority Data

Apr. 15, 1994 [JP] Japan ..... 6-077274

[51] Int. Cl.[6] ..... G03G 15/20

[52] U.S. Cl. ..... 399/69; 219/216; 399/341; 399/364

[58] Field of Search ..... 355/208, 285, 355/319; 219/216; 118/59, 101

[56] References Cited

U.S. PATENT DOCUMENTS

| | | | |
|---|---|---|---|
| 3,548,783 | 12/1970 | Knapp | 355/319 X |
| 4,591,884 | 5/1986 | Miyamoto et al. | 355/319 X |
| 5,179,417 | 1/1993 | Sugaya et al. | 355/319 |
| 5,247,336 | 9/1993 | Mills, III | 355/285 |
| 5,291,255 | 3/1994 | Britto et al. | 355/285 |
| 5,408,302 | 4/1995 | Manzer et al. | 355/285 |
| 5,420,662 | 5/1995 | Gerstner | 355/319 X |
| 5,428,433 | 6/1995 | Kopp et al. | 355/285 |
| 5,436,104 | 7/1995 | Yasuda et al. | 355/285 X |

FOREIGN PATENT DOCUMENTS

| | | |
|---|---|---|
| 60-225182 | 11/1985 | Japan . |
| 6-95550 | 4/1994 | Japan . |

*Primary Examiner*—Arthur T. Grimley
*Assistant Examiner*—Sophia S. Chen
*Attorney, Agent, or Firm*—Antonelli, Terry, Stout & Kraus, LLP

[57] ABSTRACT

Preheating temperature of a preheating plate provided on the front side of a fixing unit can be changed using a temperature controller. In a case where a printing system to print images on both sides of a print member is constructed by arranging two electrophotographic printing apparatuses in dependent relationship, the preheating temperature of the preheating plate in the electrophotographic printing apparatus in the second stage is changed to a low temperature to prevent the toner image fixed in the electrophotographic printing apparatus in the first stage from softening.

5 Claims, 2 Drawing Sheets

PREHEATING CONTROLLER FOR A TWO-STAGE ELECTROPHOTOGRAPHIC PRINTING SYSTEM

This application is a Continuation of application Ser. No. 08/418,433, filed Apr. 7, 1995, which became abandoned on Aug. 29, 1996.

BACKGROUND OF THE INVENTION

The present invention relates to an electrophotographic printing apparatus which obtains a print by fixing a toner image formed on the surface of a print member and a printing system to print on the double-side surfaces of a print member using said electrophotographic printing apparatus.

An electrophotographic printing system of the double-side printing type has been proposed. In such a system, a paper reversing apparatus to reverse a print paper is installed between two electrophotographic printing apparatuses of the one-side printing type arranged side by side. An image is first printed on the front side surface of a print paper using an electrophotographic printing apparatus in a first stage. The print paper having a printed image on the front surface is reversed using said paper reversing apparatus, and the print paper is supplied to an electrophotographic printing apparatus in a second stage to print an image on the back side surface of said print paper. In a printing system of this type, a controller to operate two electrophotographic printing apparatuses in linkage with each other is described in U.S. Pat. No. 4,774,524 (1988). A print paper transporting apparatus and a fixing apparatus disposed between two electrophotographic printing apparatuses are described in U.S. Pat. No. 5,179,417 (1993).

An electrophotographic printing apparatus having a high printing speed provides preheating means in front of a fixing unit. The preheating means preheats a print paper when its preheating plate comes into contact with the surface of the paper opposite to the surface on which a toner image is transferred. In an electrophotographic printing system constructed to print images on both sides of a print paper, there is a fixed toner image (picture) fixed in the printing process of the electrophotographic printing apparatus in the first stage on the surface of the print paper opposite to the surface on which an image is to be printed by the electrophotographic printing apparatus in the second stage. Therefore, the preheating means of the electrophotographic printing apparatus in the second stage preheats the printing paper by contacting the surface on which the fixed toner image is formed. When the paper is excessively preheated, the fixed toner image is softened again and attaches to the preheating plate and the margin of the print paper so as to stain the apparatus and degrade the printing quality.

The amount of preheating by the preheating means in a electrophotographic printing apparatus of the one-side printing type is generally set under an assumption that there is no fixed toner image on the surface of a print paper contacting the pre-heating plate. In order to realize a good fixing characteristic in a high speed printing, it is preferable that the preheating means preheat the print paper up to a temperature at which the toner image is softened. Therefore, the preheating plate is heated up to a fairly high temperature. In a case where an electrophotographic printing system of the double-side printing type is constructed using two electrophotographic printing apparatuses of the one-side printing type having preheating means for preheating a print paper up to such a high temperature, the fixed toner image is softened again and attaches to the preheating plate and the margin of the print paper so as to stain the apparatus and degrade the printing quality, as described above.

A countermeasure for preventing the softening of fixed toner image can be realized by lowering the preheating temperature of the pre-heating means for the print paper. However, it is impossible to construct an electrophotographic printing system of the double-side printing type having high speed printing by using a electrophotographic printing apparatuses having a low preheating temperature.

If an electrophotographic printing system of the double-side printing type is constructed by using an electrophotographic printing apparatus having a high preheating temperature in the head first stage and an electrophotographic printing apparatus having a low preheating temperature in the second stage, it is necessary to provide two kinds of electrophotographic printing apparatuses. In addition to this, the heat added for fixing a toner image in the electrophotographic printing apparatus in the first stage remains in the print paper supplied to the electrophotographic printing apparatus in the second stage. Therefore, the preheating means used in the electrophotographic printing apparatus in the second stage is required to be set to a smaller amount of preheating while taking the retained heat into consideration. When one of the two electrophotographic printing apparatuses in the electrophotographic printing system is independently used for one-side printing, the electrophotographic printing apparatus in the second stage performs an image printing on print paper which is at room temperature, i.e. without having any retained heat. Therefore, in the preheating means set to a low amount of preheating in consideration of the retained heat, the printing quality is degraded by a decrease in the fixing force of the toner image due to the low preheating temperature of the print paper.

SUMMARY OF THE INVENTION

An object of the present invention is to provide an electrophotographic printing system which is capable of performing double-side printing at a high printing speed and with a high printing quality by using two electrophotographic printing apparatuses of the one-side printing type having preheating means.

Another object of the present invention is to provide an electrophotographic printing system composed of two electrophotographic printing apparatuses of the one-side printing type having preheating means which is capable of performing one-side printing having a high printing quality by independently operating one of the two electrophotographic printing apparatuses.

A further object of the present invention is to propose an electrophotographic printing apparatus of the one-side printing type which is suitable for use in an electrophotographic printing system as described above and which is capable of performing one-side printing having a high printing quality by independently using it.

A feature of the present invention involves that an electrophotographic printing system for printing on the back side surface of a print paper by arranging two electrophotographic apparatuses in dependent relationship and by reversing the print paper whose front side surface is printed by the electrophotographic printing apparatus in the first stage to supply it to the electrophotographic printing apparatus in the second stage, wherein the electrophotographic printing apparatus in the second stage is capable of changing the preheating temperature of preheating means provided in the front side of its fixing unit.

In particular, the feature involves an electrophotographic printing apparatus in the second stage controlling the preheating temperature to a low value so that the fixed toner image printed by the electrophotographic printing apparatus in the first stage is not melted by preheating in the electrophotographic printing apparatus in the second stage.

Anther feature of the present invention is that an electrophotographic printing apparatus, having preheating means for preheating a print paper transported toward a fixing unit in the front side of said fixing unit, comprises a temperature controller capable of changing the preheating temperature of said preheating means.

DETAILED DESCRIPTION OF THE PREFERRED EMBODIMENTS

The embodiment of the present invention will be described below, referring to the accompanying drawings.

Figure 2:
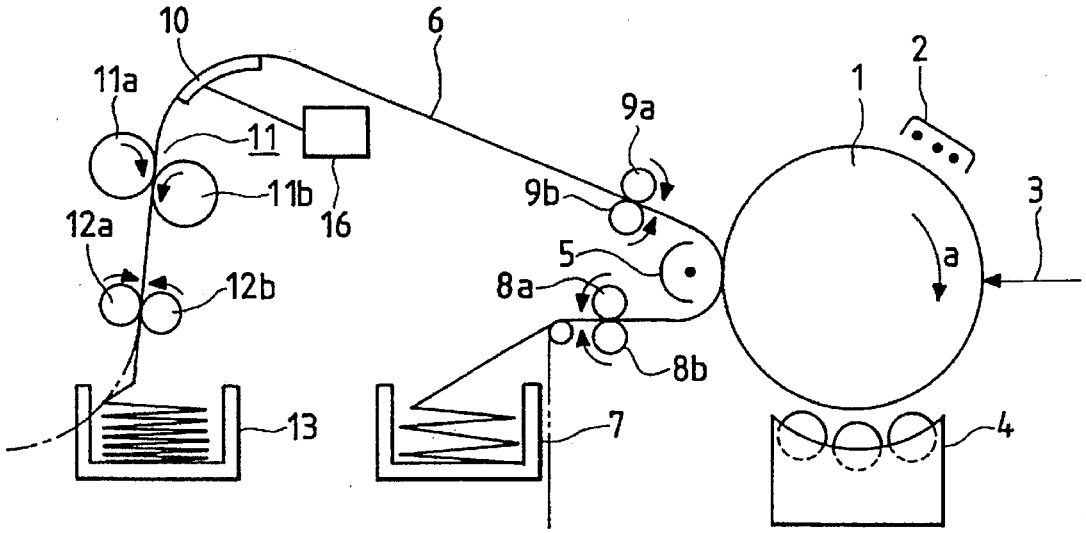
FIG. 2 is a schematic view of an electrophotographic printing apparatus in accordance with the present invention.

Firstly, an electrophotographic printing apparatus for one-side printing will be described, referring to FIG. 2. The reference character 1 indicates a photosensitive drum forming a toner image through an electrophotographic process and is supported with bearings in such a way as to be rotated in the direction shown by the arrow a at a constant speed. A charging unit 2 is arranged in facing relation to the surface of the photosensitive drum 1 to uniformly charge the surface of the photosensitive drum 1 facing the charging unit 2. A laser beam 3 for exposing the uniformly charged surface of the photosensitive drum 1 forms an electrostatic latent image on the surface of the photosensitive drum 1 as it is modulated corresponding to a print information signal supplied from an information processing unit. A developing unit 4 is arranged in facing relation to the surface of the photosensitive drum 1 on which the electrostatic latent image is formed. The developing unit 4 has a developing function in which a toner image is formed by attaching a fine-powder toner to the surface of the photosensitive drum 1 by the electrostatic force of the electrostatic latent image.

A paper hopper 7 contains, in a folded state, a continuous belt-shaped print paper 6 on which an image is formed by transferring and fixing the toner image from the photosensitive drum 1. Transporting rollers 8*a*, 8*b* composing a part of print paper transporting means extract the print paper 6 from the hopper 7 to send it to the photosensitive drum 1. The paper 6 sent from the transporting rollers 8*a*, 8*b* contact the surface of the photosensitive drum 1 to have transferred thereto the image carried by the drum. A transfer unit 5 supplies a charge having a polarity opposite to the polarity of the toner image onto the back side surface of the print paper 6 in contact with the surface of the photosensitive drum 1 to generate the electrostatic force for moving (transferring) the toner image formed on the surface of the photosensitive drum 1 to the surface of the print paper 6.

Transporting rollers 9*a*, 9*b* composing another part of the paper transporting means transfer the print paper 6 carrying the toner image into contact with a preheating plate 10 composing a part of the preheating means. The preheating plate 10 is arranged in a position in the front side of a fixing unit 11 to preheat the print paper 6 by contacting the back side surface of the print paper 6 opposite to the surface having the toner image.

Figure 3:
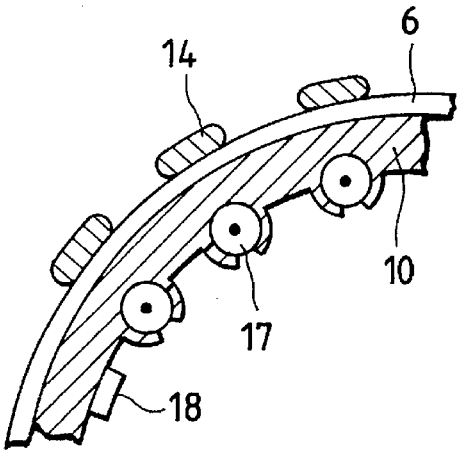
FIG. 3 and FIG. 4 are cross-sectional views showing the states of preheating of a print paper by a preheating plate.

The preheating plate 10 has a construction, as shown in FIG. 3, in which electric heaters 17 and a thermistor 18 are provided on the reverse side of a heat transfer member contacting the back side surface of the print paper 6. The preheating plate 10 will heat the print paper 6 up to the temperature at which said toner image 14 attached to said printing paper 6 is softened while said print paper 6 is being transported in contact with the surface of the preheating plate. The temperature of the preheating plate 10 is regulated by controlling the current supplied to the electric heaters 17 using a temperature controller 16.

The fixing unit 11, having a heating roller 11*a* and a pressing roller 11*b* facing each other, fixes the toner image 14 onto the surface of the print paper 6 by heating and pressing the print paper 6 which has been preheated by the preheating plate 10.

Puller rollers 12*a*, 12*b* pull the print paper 6 sent from the fixing unit 11 to fold and store it into a stacker 13 or to discharge it outside the apparatus.

Figure 5:
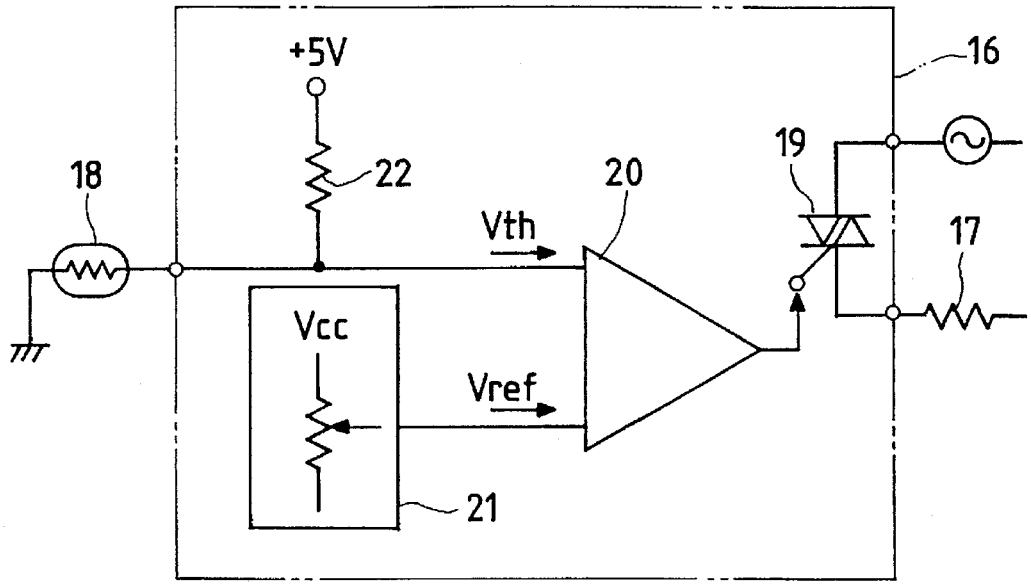
FIG. 5 is a schematic circuit diagram of a temperature controller in accordance with the present invention.

The construction of the temperature controller 16 will be described below, referring to FIG. 5. A bi-directional thyristor 19 connected to an alternating power source in series with the electric heaters 17, is controlled in its ON/OFF state by the control signal put out from a comparator 20. The reference voltage $V_{ref}$ applied to the comparator 20 is generated in a reference voltage generator 21. The reference voltage generator 21 has a potentiometer of the manual operating type for putting-out a required voltage by attenuating a constant voltage and a variable voltage generating circuit for generating a voltage corresponding to a control information signal given from a higher-level control unit. The detected temperature voltage put out from the junction point of the thermistor 18 and attenuation resistor 22 is supplied to the comparator as a compared voltage $V_{th}$. The compared voltage $V_{th}$ is proportional to the resistance of the thermistor 18, that is, the temperature of the preheating plate 10. The reference voltage generator 21 generates a reference voltage $V_{ref}$ which is equal to the compared voltage $V_{th}$ generated when the temperature of the preheating plate 10 is at the desired temperature. The magnitude of the reference voltage $V_{ref}$ is set to a value equivalent to the desired temperature to heat the preheating plate 10 by manual operation or with the higher-level control unit. The comparator 20 compares the compared voltage $V_{th}$ with the reference voltage $V_{ref}$, and changes the amount of generating heat of the electric heaters 17 by controlling the ON/OFF state of the bi-directional thyristor 19 so that the compared voltage $V_{th}$ becomes equal to the reference voltage $V_{ref}$.

Figure 1:
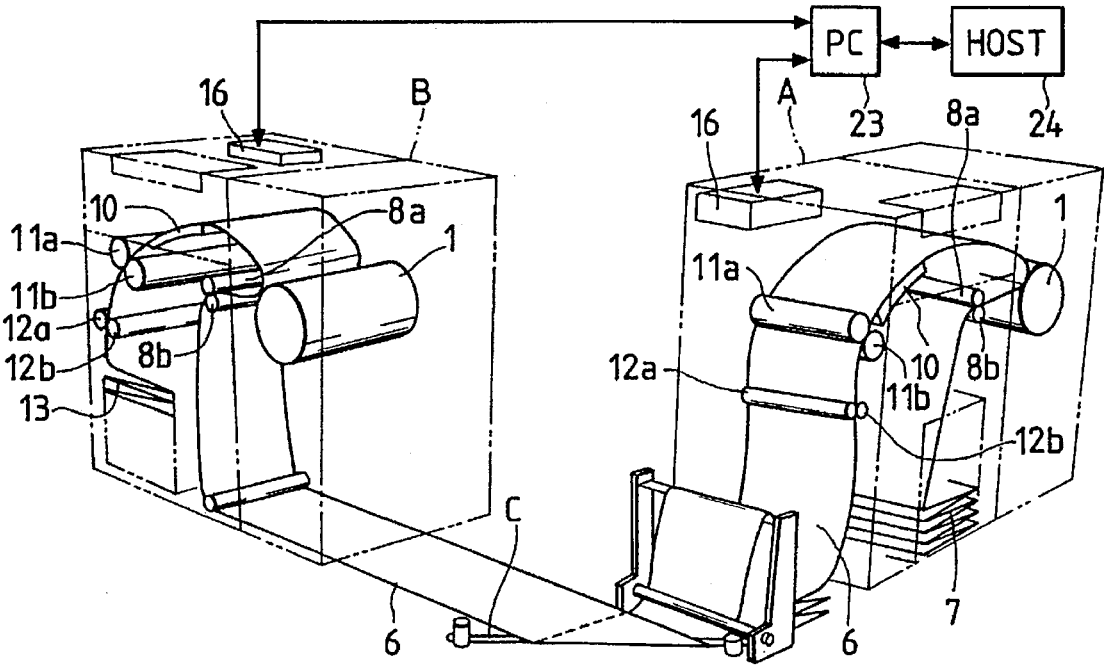
FIG. 1 is a perspective view of an electrophotographic printing system in accordance with the present invention.

FIG. 1 shows an electrophotographic printing system of the double-side printing type constructed using two electrophotographic printing apparatuses A, B of one-side printing type. The electrophotographic printing apparatus A in the first stage and the electrophotographic printing apparatus B in the second stage are arranged so as to be connected to each other in dependent relationship. A print paper reversing apparatus C is placed between the electrophotographic printing apparatus A and the electrophotographic printing apparatus B. Therein, the print paper reversing apparatus reverses the print paper 6 discharged from the electrophotographic printing apparatus A after completion of printing on the front side surface and supplies it to the electrophotographic printing apparatus B. Then, the electrophotographic printing apparatus B prints an image on the back side surface of the print paper 6.

In this electrophotographic printing system, the electrophotographic printing apparatus A prints an image by extracting the print paper 6 from the hopper 7, and discharges the print paper 6 after completion of printing. The electrophotographic printing apparatus B prints an image on the print paper 6 received from the print paper reversing apparatus C, and stores the print paper 6 after completion of printing into the stacker 13.

A printer controller 23, forming a part of the higher-level control unit in the control system of the electrophotographic printing apparatus, controls the two electrophotographic printing apparatuses A, B corresponding to the print information given from a host computer 24 in a further-high-level. When images are printed on the front side surface and on the back side surface of print paper 6 by operation of the two electrophotographic printing apparatuses A, B, the printer controller adjusts the timing of the latent image forming using the laser beam 3 in each of the electrophotographic printing apparatuses A, B in such a way that the printed image on the front side surface and the printed image on the back side surface have a certain relationship, and gives control information expressing in which stage of the double-side printing, the first stage or the second stage, the electrophotographic printing apparatus is controlled by the temperature controller 16.

There is no toner image on the back side surface of the print paper 6 contacting the preheating plate 10 on the electrophotographic printing apparatus A in the first stage as shown in FIG. 3. Therefore, the reference voltage generator 21 of apparatus A operates so as to generate a reference voltage $V_{ref}$ for controlling the preheating plate 10 to a high temperature, and the temperature controller 16 in the electrophotographic printing apparatus A in the head stage heats the preheating plate 10 so as to preheat the print paper 6 up to a temperature at which the toner image 14 attached to the front side surface of the print paper 6 is softened.

Figure 4:
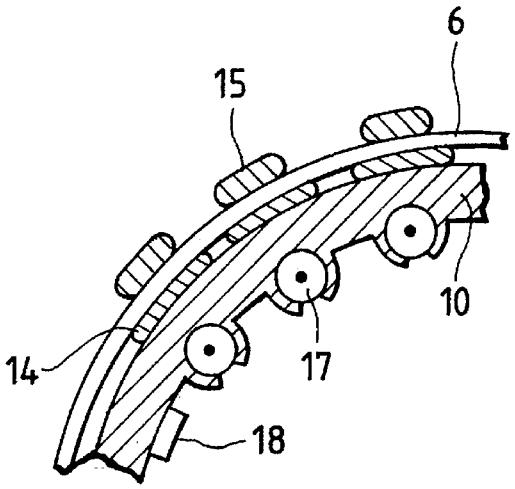

There is a toner image on the back side surface of the print paper 6 (the surface on which the image is printed in the electrophotographic printing apparatus A in the first stage) contacting the preheating plate 10 on the electrophotographic printing apparatus B the second stage, as shown in FIG. 4. Therein, the toner image indicated by the reference character 15 is the image formed in the electrophotographic printing apparatus B in the second stage. Therefore, the reference voltage generator 21 of apparatus B operates so as to generate a reference voltage $V_{ref}$ for controlling the preheating plate 10 to a low temperature, and the temperature controller 16 in the electrophotographic printing apparatus B in the second stage heats the preheating plate 10 so as to preheat the print paper 6 to a low temperature at which the toner image 14 attached to the front side surface of the print paper 6 is not softened.

It is preferable that the low preheating temperature is lower than the glass transition temperature of the toner used.

The two electrophotographic printing apparatuses A and B can be used independently by disconnecting their linkage. In the independent state, each of the two electrophotographic printing apparatuses A and B prints an image by extracting a print paper 6 from an individual hopper 7, and stores the print paper 6 after completion of printing into an individual stacker 13.

In such an operating state, there is no toner image on the surface of the print paper 6 contacting the preheating plate 10 on the electrophotographic printing apparatus A or B. Therefore, the reference voltage generator 21 of each apparatus A and B operates so as to generate a reference voltage $V_{ref}$ for controlling the corresponding preheating plate 10 to a high temperature, and the temperature controller 16 in each electrophotographic printing apparatus A and B heats the preheating plate 10 so as to preheat the print paper 6 up to a temperature at which the toner image 14 attached to the front side surface of the print paper 6 is softened.

It may become easier to operate the electrophotographic printing system if an input switch is provided in the temperature controller 16 so that the control information to change the preheating temperature as described above may be manually input.

What is claimed is:

1. An electrophotographic printing system comprising:

first and second electrophotographic printing apparatuses adapted to be operated in series as a two stage printing system to perform, respectively, first and second stage printing operations, each electrophotographic printing apparatus including electrophotographic process executing means for forming a toner image on a print member, fixing means for fixing the toner image to the print member by melting the toner image, print member transporting means for transporting the print member having the toner image formed thereon from said electrophotographic process executing means to said fixing means, and preheating means for preheating the print member as it is being transported from said electrophotographic process executing means to said fixing means; and a print member reversing apparatus provided between said first and second electrophotographic printing apparatuses, for reversing the print member discharged from said first electrophotographic printing apparatus after the first stage printing operation and supplying the reversed print member to said second electrophotographic printing apparatus for the second stage printing operation; wherein:

at least said second electrophotographic printing apparatus includes a temperature controller for controlling said preheating means of said second electrophotographic printing apparatus to maintain said preheating means of said second electrophotographic printing apparatus at a temperature below the fixing temperature of the toner image formed by said first electrophotographic printing apparatus in the first stage printing operation.

2. An electrophotographic printing system according to claim 1, wherein:

said first electrophotographic printing apparatus includes a temperature controller; and said temperature controller of said second electrophotographic printing apparatus controls said preheating means of said second electrophotographic printing apparatus so that said, preheating means of said second electrophotographic printing apparatus has a lower temperature than said preheating means of said first electrophotographic printing apparatus.

3. An electrophotographic printing system according to claim 1, wherein:

said first electrophotographic printing apparatus includes a temperature controller; and the temperature controller of each of said first and second electrophotographic printing apparatuses selectively controls the preheating temperature of the corresponding preheating means to a high temperature and to a low temperature.

4. An electrophotographic printing system according to claim 3, wherein:

the temperature controller of each of said first and second electrophotographic printing apparatuses controls the preheating temperature of the corresponding preheating means to set the low temperature below the glass transition point of toner in the toner image.

5. An electrophotographic printing system as claimed in claim 1, wherein each electrophotographic process executing means comprises a photosensitive drum; a charging unit for uniformly charging the surface of said photosensitive drum; a laser beam source for exposing the surface of said photosensitive drum with a laser beam modulated in accordance with print information, to form a electrostatic latent image of the print information; and a developing unit for developing the electrostatic latent image by applying toner to the surface of said photosensitive drum to form a toner image of the print information.

* * * * *